US010607443B2

(12) United States Patent
Berman et al.

(10) Patent No.: US 10,607,443 B2
(45) Date of Patent: Mar. 31, 2020

(54) GAMING SYSTEMS, APPARATUSES AND METHODS FOR PROVIDING LAYERED ACCESS PAYOUT MODIFIERS

(71) Applicant: KING SHOW GAMES, INC., Minnetonka, MN (US)

(72) Inventors: Bradley Berman, Minnetonka, MN (US); Jacob Lamb, Maple Grove, MN (US)

( * ) Notice: Subject to any disclaimer, the term of this patent is extended or adjusted under 35 U.S.C. 154(b) by 0 days.

(21) Appl. No.: 15/805,283

(22) Filed: Nov. 7, 2017

(65) Prior Publication Data

US 2018/0130296 A1 May 10, 2018

Related U.S. Application Data

(60) Provisional application No. 62/419,425, filed on Nov. 8, 2016.

(51) Int. Cl.
*G07F 17/32* (2006.01)
*G07F 17/34* (2006.01)

(52) U.S. Cl.
CPC ..... *G07F 17/3244* (2013.01); *G07F 17/3209* (2013.01); *G07F 17/3213* (2013.01); *G07F 17/34* (2013.01)

(58) Field of Classification Search
CPC ..... G07F 17/32
See application file for complete search history.

(56) References Cited

U.S. PATENT DOCUMENTS

| | | | | |
|---|---|---|---|---|
| 6,413,161 | B1 * | 7/2002 | Baerlocher | G07F 17/32 273/143 R |
| 2002/0045474 | A1 * | 4/2002 | Singer | G07F 17/32 463/20 |
| 2006/0142077 | A1 * | 6/2006 | Miles | G07F 17/32 463/20 |

* cited by examiner

*Primary Examiner* — Kevin Y Kim

(57) ABSTRACT

Systems, apparatuses and methods for facilitating random payout enhancements using layered payout enhancement opportunities. The game features provide payout enhancements, such as multipliers and other modifiers, using multi-layered elements of chance. One embodiment involves a group or collection of payout enhancement prospects, supplied and accessible in an ordered sequence or layers, that is randomly provided to the player with payout modifiers or other enhancements during the temporarily-sustained payout enhancement feature.

20 Claims, 11 Drawing Sheets

GAMING SYSTEMS, APPARATUSES AND METHODS FOR PROVIDING LAYERED ACCESS PAYOUT MODIFIERS

FIELD

This disclosure relates generally to games, and more particularly to gaming systems, apparatuses and methods for facilitating random payout enhancements using layered payout enhancement opportunities.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to provide payout enhancements using layered payout enhancement opportunities.

In one embodiment, a slot game apparatus is provided to enhance gaming payouts in a slot game utilizing symbols in a symbol grid to determine payouts. The slot game apparatus includes a display, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to activate a temporarily-sustained collection of payout modifier opportunities, conceal a quantity of the payout modifier opportunities from a player of the slot game, and provide multiple chances to obtain the next one of the collection of payout modifier opportunities while the temporarily-sustained collection is activated. The processor is further configured to maintain activation of the temporarily-sustained collection of payout modifier opportunities when the next provided payout modifier opportunity identifies no payout modifier. The processor is also configured to provide a payout modifier in addition to maintaining activation of the temporarily-sustained collection of payout modifier opportunities, when the next provided payout modifier opportunity has a payout modifier associated therewith. The processor is also configured to apply the payout modifier to slot game payouts until the next payout modifier opportunity is provided, and to deactivate the temporarily-sustained collection of payout modifier opportunities when all of the payout modifier opportunities have been provided.

In a more particular embodiment of such a slot game apparatus, the temporarily-sustained collection of payout modifier opportunities includes a series of layered elements, each including one of the payout modifier opportunities, where the processor is configured to provide the next one payout modifier opportunity of the collection by revealing the next layer of the series of layered elements. In another particular embodiment, the processor is further configured to deactivate the temporarily-sustained collection of payout modifier opportunities when there is no next layer of the series of layered elements. In one embodiment, the processor is further configured to reveal the next layer of the series of layered elements without revealing the remaining quantity of the series of layered elements. In yet another particular embodiment, the series of layered elements includes a set of nested matryoshka dolls, each of which includes one of the payout modifier opportunities, where the processor is configured to provide the next one of payout modifier opportunities of the collection by revealing the next nested matryoshka doll.

In another particular embodiment of such a slot game apparatus, the processor is configured to apply the modifier to all of the payouts occurring in connection with a plurality of the slot game events until the next one of the collection of payout modifier opportunities is provided. In another embodiment, the processor is further configured to activate the temporarily-sustained collection of payout modifier opportunities in response to occurrence of a random event occurring in connection with participation of one of the slot game events. In still another embodiment, the processor is further configured to provide multiple chances to obtain the next one of the payout modifier opportunities of the collection by randomly providing a visual identifier in connection with a plurality of the slot game events occurring during the temporarily-sustained collection of payout modifier opportunities.

In another embodiment of such a slot game apparatus, at least one of the payout modifier opportunities includes the payout modifier, and at least one of the other payout modifier opportunities does not include the payout modifier. In a more particular embodiment, multiple payout modifier opportunities include payout modifiers, and at least two different modifier values are respectively provided by way of the plurality of the payout modifier opportunities.

In another embodiment, a slot game apparatus is provided for enhancing gaming awards in a slot game having discrete slot game events where symbols are randomly positioned in respective symbol positions of a symbol grid to determine payouts. The slot game apparatus includes a display, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to randomly activate a layered multiplier element having a plurality of layers made available one at a time in response to random events occurring in connection with slot game reel spin events while the layered payout multiplier element is activated, and to associate a multiplier award with at least one of the plurality of layers. In response to the occurrence of each of the random events, the processor is configured to determine whether or not the layer that is currently made available includes a multiplier award. If the layer currently made available includes the multiplier award, the processor is configured to apply the multiplier award to the payouts of the slot game events to increase the payouts for a plurality of the slot game reel spin events, until the occurrence of a next one of the random events occurring in connection with the slot game reel spin events. The processor is configured to deactivate the layered multiplier element when a number of the plurality of layers has depleted to zero.

In a more particular embodiment of such a slot game apparatus, the processor is further configured to maintain the activation of the layered multiplier element, if the layer currently made available does not include the multiplier award, and the number of the plurality of layers has not yet depleted to zero. In still another embodiment, the processor is configured to make the plurality of layers available one at a time, revealing only the one of the plurality of layers that is currently available, and concealing any remaining ones of the plurality of layers and concealing the number of the remaining ones of the plurality of layers. Another embodiment involves configuring the processor to make the plurality of layers available one at a time, revealing only the one of the plurality of layers that is currently available and concealing any remaining ones of the plurality of layers, and revealing the number of the remaining ones of the plurality of layers. Still another embodiment involves the processor being configured to apply the multiplier award by multiplying all of the payouts during the plurality of the slot game reel spin events until the occurrence of the next one of the random events occurring in connection with the slot game reel spin events.

Still other embodiments of such a slot game apparatus include configuring the processor to create the random events to make available, at times but not always, one of the plurality of layers for the determination of whether or not the layer that is currently made available includes the multiplier award. In another embodiment, the random event is selected from the group comprising a special symbol, a symbol overlay, a sub-symbol, and an indication separate from the slot game reel spin event. In yet another embodiment, the multiplier award comprises any of a plurality of available multiplier values.

In another embodiment, a slot game apparatus is provided for enhancing gaming awards in a slot game having discrete slot game events where symbols are randomly positioned in respective symbol positions of a symbol grid to determine payouts. The slot game apparatus includes a display, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to randomly activate a layered multiplier element having a plurality of layers made available one at a time in response to random events occurring in connection with slot game reel spin events while the layered payout multiplier element is activated, and to associate a multiplier award with at least one of the plurality of layers. In response to the occurrence of each of the random events, the processor is configured to determine whether or not the layer that is currently made available includes a multiplier award. If the layer currently made available includes the multiplier award, the processor is configured to apply the multiplier award to the payouts of the slot game events to increase the payouts for a plurality of the slot game reel spin events, until a number of the slot game reel spin events has occurred. The processor is configured to deactivate the layered multiplier element when a number of the plurality of layers has depleted to zero.

In one particular embodiment of such a slot game apparatus, the processor is configured to apply the multiplier awards until a predetermined number of the slot game reel spin events has occurred.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
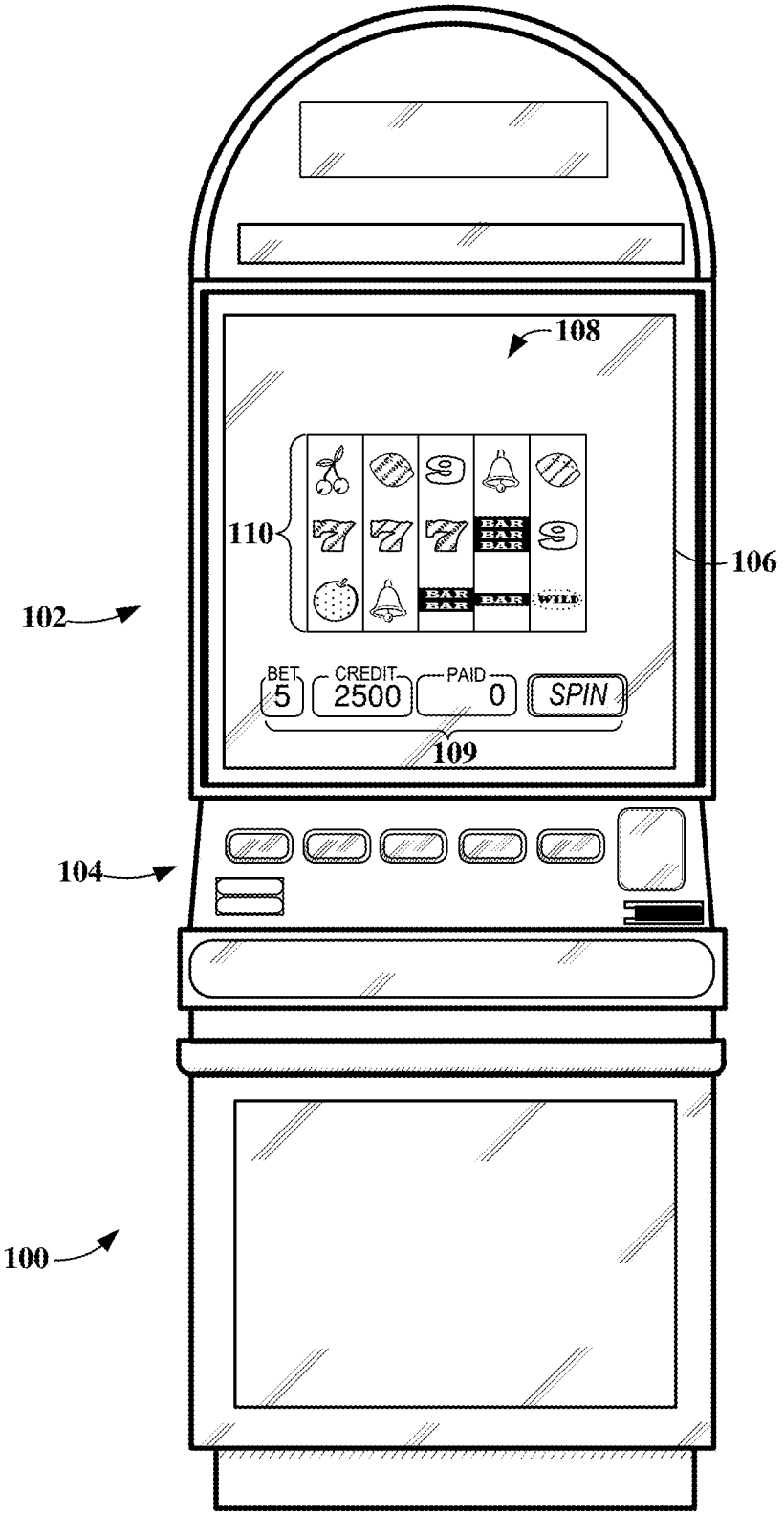
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for facilitating random payout enhancements using layered payout enhancement opportunities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that randomly provides payout enhancements, such as multipliers and other modifiers, using multi-layered elements of chance. For example, the disclosure teaches manners in which a group or collection of payout enhancement prospects, supplied and accessible in an ordered sequence or pattern, is randomly provided to the player with payout modifiers or other enhancements during the temporarily-sustained payout enhancement feature.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
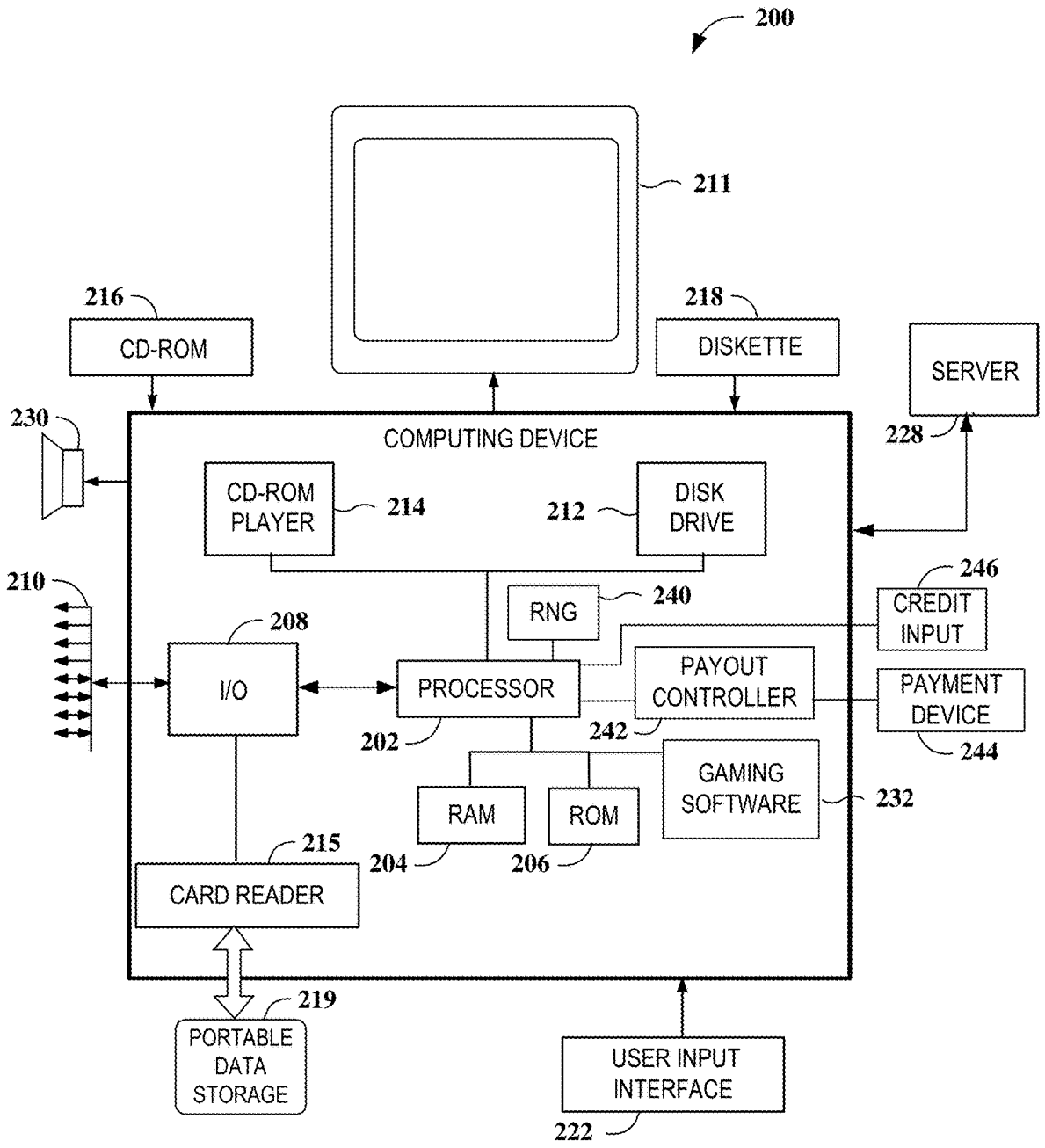
FIG. 2 is a block diagram illustrating a representative computing arrangement capable of implementing games and features in accordance with the invention and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, the game features provide payout enhancements, such as multipliers and other modifiers, using multi-layered elements of chance. For example, the disclosure teaches manners in which a group or collection of payout enhancement prospects, supplied and accessible in an ordered sequence or pattern, is randomly provided to the player with payout modifiers or other enhancements during the temporarily-sustained payout enhancement feature.

Figure 3:
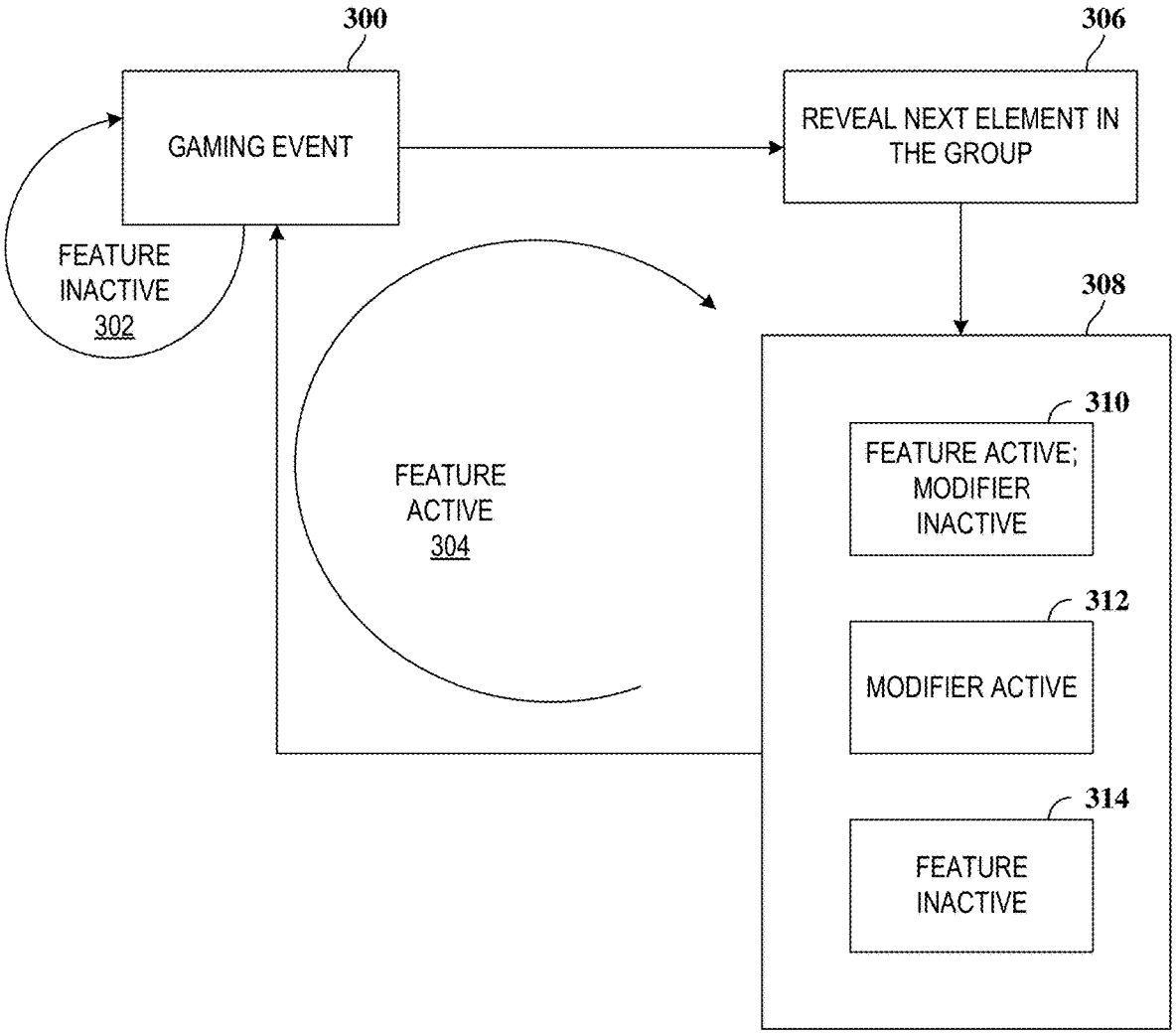
FIG. 3 is a block diagram illustrating a representative manner in which gaming payout modifiers may be randomly applied to gaming payouts.

FIG. 3 is a block diagram illustrating a representative manner in which gaming payout modifiers may be randomly applied to gaming payouts. In one embodiment, a gaming activity including gaming events 300 is provided to players. The present disclosure may be used in connection with any gaming activity, such as wager-based gaming activities (whether using real money or not), including but not limited to slot games, poker games, keno games, roulette, bingo, etc. The gaming activity represents a game where payouts or other returns are awarded in response to random or at least partially random events. In accordance with the present disclosure, enhancements to such payouts may be provided to provide further excitement and anticipation in the gaming events 300 of the gaming activity. In one embodiment, these payout enhancements are provided by way of gaming features that enable payout modifiers to be randomly presented for use in enhancing gaming events 300 payouts and or providing direct payouts to the player.

While the gaming payout enhancement features are inactive 302, participation in the gaming events 300 continues normally. When the gaming payout enhancement features are active 304, payouts associated with the gaming event 300 may be enhanced to provide improved payouts in size, quality, frequency, etc. In various embodiments, the payout enhancement features described herein facilitate random payout enhancements that may be triggered randomly, provide greater suspense and/or anticipation during the feature play, and/or provide varying degrees of enhancements, etc. In one exemplary embodiment, a payout enhancement feature is randomly triggered, resulting in a temporarily-sustained payout enhancement state during which different payout modifiers may be randomly awarded until the payout enhancement state expires.

In one embodiment, a random event activates 304 the payout enhancement feature. Once the feature is activated, the temporarily-sustained payout enhancement feature provides the player with the opportunity to receive payout enhancements, such as modifiers that apply to gaming event 300 payouts. A group or collection of payout enhancement prospects, supplied and accessible in an ordered sequence or pattern, randomly provide the player with payout modifiers or other enhancements during the temporarily-sustained payout enhancement feature.

The payout enhancement feature may be activated in any desired manner. In one embodiment, described in greater detail below, the payout enhancement feature is triggered by some events occurring in connection with the gaming event 300, such as a special symbol, sub-symbol, symbol overlay, symbol combination, etc. Once triggered, the collection of payout enhancement elements, which serve as payout enhancement prospects for receiving payout modifiers, begin to reveal 306 themselves to identify whether a payout modifier has been awarded. In one embodiment, one of the payout enhancement elements is revealed in connection with each gaming event of the gaming event 300, such as, for example, each reel spin of a slot game, or each hand of a poker game, or each set of numbers in keno, or each spin in a roulette game, or each letter called in a bingo game or each bingo game itself, etc. The constituent elements of the collection of payout enhancement elements may be any plurality of items, where in one embodiment each item is hidden, and one of the items is revealed at a time. This could include physical or virtual/electronic visualizations of, for example, pages turning, matryoshka dolls, layered gift packages (e.g., smaller gift packages inside larger ones), and/or any other collection of multiple items that can be revealed until one (and in some embodiments two or more) of the payout enhancement elements is revealed to potentially award payout modifiers, direct payouts (e.g., credit awards), and/or other gaming activity payout enhancements. In one embodiment, the number of payout enhancement elements in the collection is unknown, so that the player does not know when the payout enhancement feature will end, while in other embodiments the number of payout enhancement elements is known such that the player knows how many remaining chances are available to receive payout enhancement awards.

The random furnishing of payout enhancement elements from the collection of such elements occurs, in one embodiment, as long as the temporarily-sustained feature remains active. In the embodiment of FIG. 3, when the next element in the group has been revealed 306 to the player, it is determined what that next constituent element of the group provides to the player, if anything, among a plurality of potential actions 308. For example, the allocated action 308 may randomly provide a "null" option as it pertains to providing a payout enhancement, yet the feature remains alive for further chances to obtain payout enhancements. This is depicted in FIG. 3 at block 310, where the feature remains active, but the modifier or other payout enhancement is inactive for that particular gaming event (e.g., slot reel spin). Alternatively, the selected one of the payout enhancement constituents may provide an active modifier 312, such as a payout multiplier (e.g., multiply a payout by X, where "X" represents any desired number, such as two or greater), payout addend (e.g., a credit award to add to any other payout, where the credit value awarded may or may not be based on any payout award(s) in the primary game), and/or other mathematical function or enhancement. Still another potential action 308 is that the feature becomes inactive 314, i.e. the temporarily-sustained payout enhancement feature expires.

Therefore, while the feature is active 304, upon each triggering action of the gaming event 300, the next element in the group is revealed 306 and one of a plurality of potential actions 308 occurs randomly, including keeping the feature alive while providing no enhancement as shown at block 310, awarding an active modifier 312, or inactivating the temporarily-sustained feature 314. This active feature loop 304 will occur, in some embodiments, until the feature is inactivated 314, at which time the gaming event 300 continues normally with the feature inactive 302 until another triggering event occurs.

Figure 4:
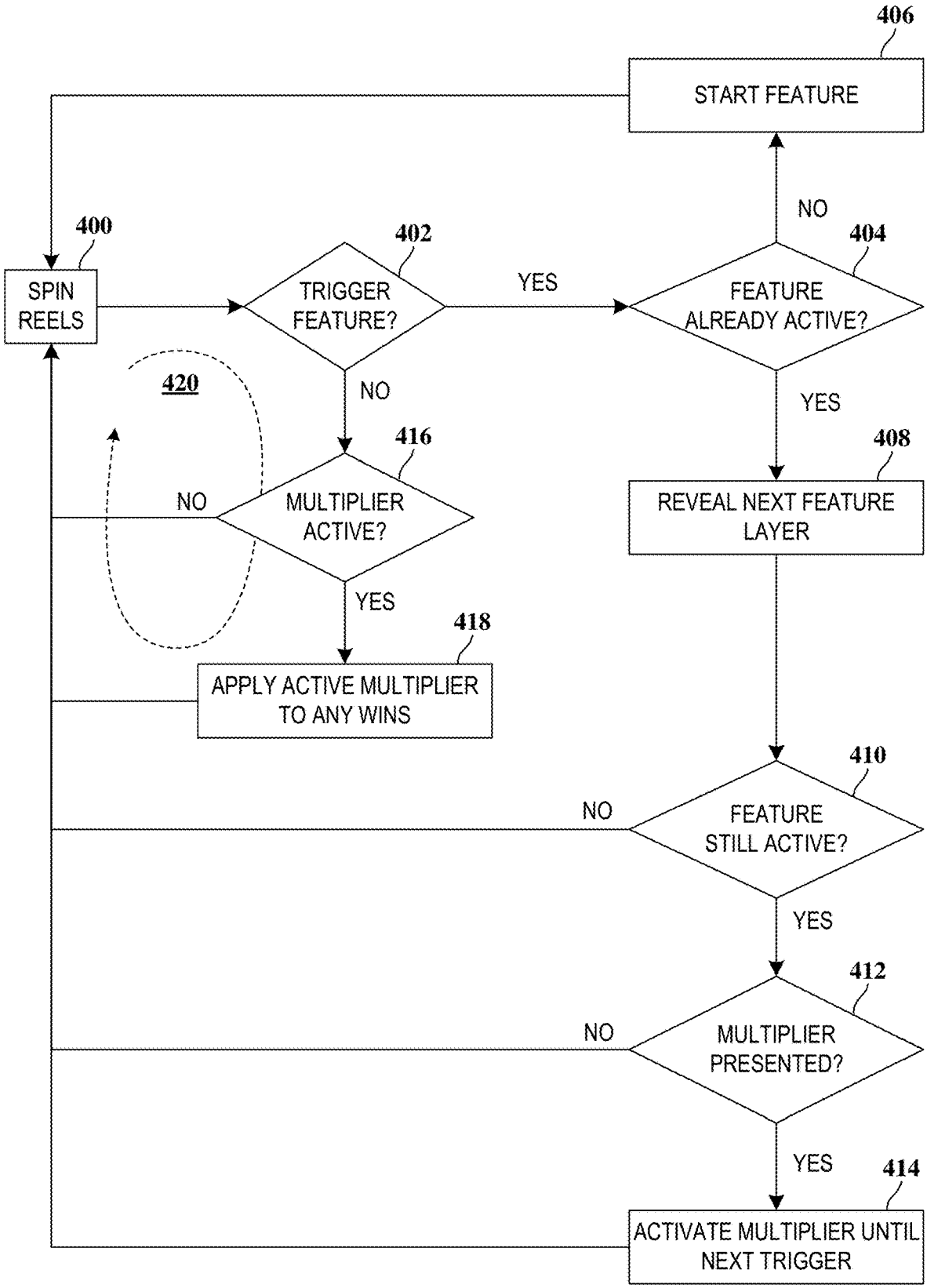
FIG. 4 depicts a representative slot game embodiment, involving a randomly-generated, temporarily-sustained payout enhancement feature that enables slot game payouts to potentially be enhanced with one or more multipliers provided by way of the payout enhancement feature.

Many embodiments may be described in terms of a slot game, where symbols are matched on paylines to determine payout awards. However, as otherwise noted, the principles described herein are equally applicable to other games of chance, as described herein and as will be readily apparent to those skilled in the art from the teachings herein. FIG. 4 is described in the context of a representative slot game embodiment, involving a randomly-generated, temporarily-sustained payout enhancement feature that enables slot game payouts to potentially be enhanced with one or more multipliers provided by way of the payout enhancement feature.

In this representative slot game embodiment, the player initiates spinning 400 the slot game reels, which is intended to include any randomization of symbols, whether reel-based or not, on a slot game grid(s) that is being played. If, as a result of spinning 400 the reels, the payout enhancement feature is triggered 402, it is then determined 404 if the feature is already active, i.e. already in a temporarily-sustained state where a grouping of payout enhancement prospects are randomly doled out. If not, the feature is started 406 and the gaming events, i.e. reel spins 400, continues. In one embodiment, rather than merely starting 406 the feature, the first layer or other constituent element of the collection of payout enhancement prospects may be revealed 408.

If it is determined 404 that the feature is already active, the next future layer is revealed 408. For example, if the collection of payout enhancement prospects comprises a number of facedown cards, some with payout enhancement awards, revealing 408 the next future layer may include turning face-up or otherwise exposing one of the cards. In other embodiments described more fully below, the layers may be provided in any desired manner, such as a collection of nested cylinders, cans, boxes, etc., matryoshka dolls, or the like.

Upon revealing 408 the next future layer, from that revealed element, one of a plurality of actions may occur. In the example of FIG. 4, the plurality of actions includes a null state where no payout modifier is awarded while the temporarily-sustained feature remains active, providing at least one payout modifier (e.g., multiplier), and ending the feature. Therefore, it is determined 410 whether the feature is still active. If not, this indicates that the revealed 408 element causes the feature to expire or otherwise end.

If it is determined 410 that the feature is still active, then the revealed 408 element was not a feature termination element, but rather is something else. For example, the revealed 408 element may be an awarded multiplier or other modifier. If so, then the multiplier is activated 414 until, in one embodiment, the next feature trigger occurs, and the reel spinning 400 can continue. In one embodiment, the activated 414 multiplier remains active and applies to all payouts of the gaming events (reel spins 400) until another feature trigger 402 occurs. This is depicted via the loop 420, where if a feature trigger has not again occurred, and the activated 414 multiplier is still active, then that awarded multiplier is applied 418 to any wins and consequent payouts that occur. For example, if four reel spins 400 occurred from the time a 5× multiplier was activated 414 until it is determined 402 that another feature trigger occurred, and during those four reel spins 200 credits were won on various paylines, scatter pays, and/or other payouts, the player would win 1000 credits (i.e. two-hundred credits times five).

In one embodiment, if it is determined 410 that the feature is still active, but no multiplier was presented as determined at block 412, the feature remains active, but no modifier is provided. In such case, the feature continues with further spins 400 of the reels, and further opportunities to obtain multipliers by way of the feature, until the feature expires.

Figure 5:
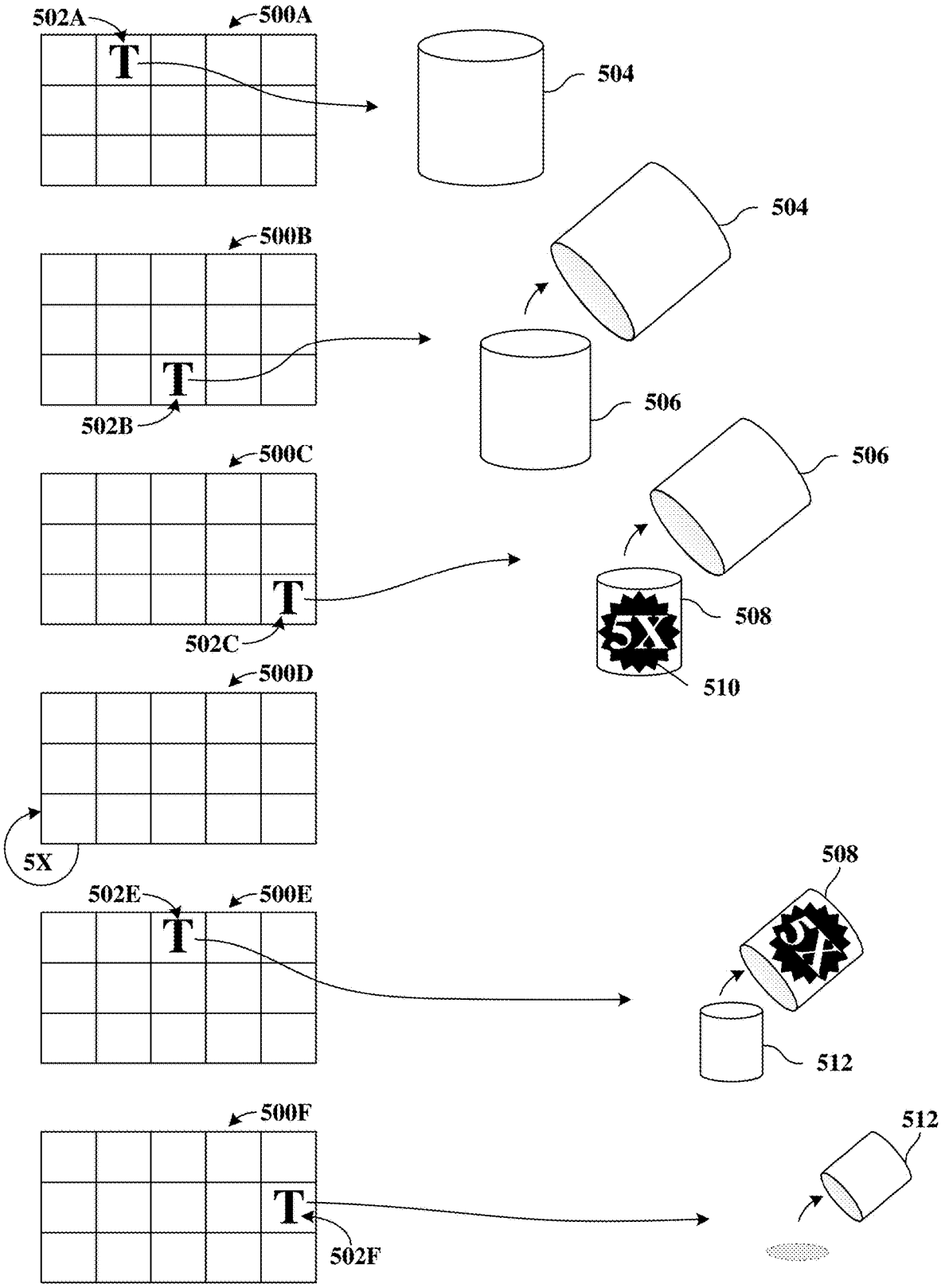
FIG. 5 is a representative example of a slot game incorporating a payout enhancement feature as described herein.

FIG. 5 is a representative example of a slot game incorporating a payout enhancement feature as described herein. This embodiment assumes any size slot grid 500A, payout multipliers as the payout enhancement modifiers, and uses multiple nested containers as the collection of payout enhancement elements. The example is described in terms of a sequence of reel spins, depicted by resulting slot grid's 500A, 500B, 500C, 500D, 500E and 500F. For ease of discussion, the slot grids 500A, 500B, 500C, 500D, 500E, 500F are not depicted as populated with symbols except for any triggering condition or symbol, although it is assumed that symbols may be included in some or all of the symbol locations of the grids. In some embodiments it is also possible to have a special reel spin for purposes of determining whether the trigger condition occurs such that other symbol positions are not yet populated with symbols for a standard gaming event.

Slot grid 500A depicts a gaming event result where a trigger symbol "T" 502A was randomly presented in the grid 500A, thereby invoking a payout enhancement feature described herein. In this embodiment, a multi-tier or multi-layer item, which includes a plurality of constituent potential payout modifiers (multipliers in this example), is presented as a container 504. In one embodiment, the initial container 504 may provide an opportunity to win a multiplier (e.g., a multiplier value may be presented when the container 504 is presented), while in other embodiments triggering the feature via an initial trigger 502A may only initiate the feature by presenting the container 504, where opportunities to obtain a multiplier or other payout enhancement element begins upon receipt of the next subsequent trigger 502B at slot grid 500B, which represents some reel spin after the initial triggering reel spin 500A.

Any triggering condition may be utilized, whereby satisfaction of the triggering condition initiates the feature and provides a layered or other multi-element collection to provide a temporarily-sustained payout multiplier opportunity. In some embodiments, additional triggering conditions may need to be satisfied to peel or remove layers of the layered element to work toward the layer associated with the multiplier. Further, any manner of identifying the trigger may be implemented, such as a special symbol (e.g., trigger symbol 502A), an overlay (e.g., a trigger indication that is positioned over another symbol, moves into a symbol position, etc.), sub-symbol, highlighted symbol position, secondary random event (e.g., spinning a wheel), or the like.

When a subsequent trigger 502B occurs after the feature has been activated, one embodiment involves changing the revealed one of the presented items, such as by uncovering the original container 504 to present another container 506. When this happens, (at least) one of a plurality of actions may occur in this embodiment. Particularly, another container 506 may be presented, which in one embodiment represents that the feature is still active and has not expired, but provides no multiplier value. In other embodiments, a container (or other element of the collection being used) that has no payout modifier may still provide some value other than just indicating that the feature remains activated, such as providing a credit value, providing a default or "token" modifier (e.g., 1.5×), free spin, etc. However, in the illustrated embodiment, an unmarked container 506 keeps a feature activated without providing any further payout enhancement.

With the feature still active, further reel spins may occur until another trigger occurs. For example, slot grid 500C represents some subsequent spin where another trigger 502C is presented. With the feature still active, in one embodiment this causes the existing container, which is container 506 at this stage, to be discarded in favor of another container 508 (i.e. revealing another layer in the collection), which in this case is randomly associated with a multiplier 510. In accordance with one embodiment, receipt of the multiplier 510 allows that multiplier 510, a 5× (five times) multiplier in this example, to be applied to particular payouts occurring during subsequent reel spins until another triggering event occurs, as depicted by slot grid 500D. The particular payouts in which the multiplier 510 is applied include, for example, all payouts occurring on the grid 500D until the next trigger occurs, payouts on a particular payline(s) until the next trigger occurs, payouts above or below some payout threshold, and/or however the game is to be defined. In one exemplary embodiment, an awarded multiplier 510 is applied to all payouts on the game grid 500D until the next trigger event occurs, and therefore the next layer in the collection of enhancement items is revealed. Therefore, in the embodiment illustrated in FIG. 5, it is assumed that if the newly revealed container 508 is associated with a payout modifier, such as a multiplier value(s) 510, then that multiplier value 510 will be available for some number of subsequent reel spins, and will impact payouts until some other triggering condition is satisfied.

When another triggering condition is met, such as receiving another trigger symbol 502E, the multiplier application state ends in one embodiment, and it is again determined whether any further layers or other items in the collection are available. In the illustrated embodiment of FIG. 5, another container 512 is indeed available when the prior container 508 is peeled off or otherwise removed to reveal the next container 512 (if any). This means that at least the feature has not yet expired. The next question is whether the new container 512 is associated with any multiplier itself, and in the present example it is not. Therefore, the feature remains activated, but without a multiplier or other modifier affecting payouts occurring in connection with the gaming events that are played.

At some point, another trigger indicator 502F May be received in connection with the slot game grid 500F. When the existing container 512 is removed to determine whether another container with or without a multiplier value is available, it can be seen in this example that there is not another container, i.e., the payout enhancement items associated with the collection have run out, thereby ending/deactivating the payout enhancement feature of this example. In one embodiment, a further random occurrence of a trigger symbol would reinitiate another temporarily-sustained payout enhancement feature, such as was described in connection with slot grid 500A, trigger symbol 502A, and initially presented collection of payout enhancement items beginning with the container 504.

In one embodiment, the payout enhancement feature may expire for other reasons and/or or at other times. For example, instead of the multiplier (e.g., multiplier 510) remaining available for payouts until another trigger occurs, the multiplier (or other modifier) could remain active for a predetermined number of reel spins (or other gaming events), or for a random number of reel spins that may or may not be communicated to the player, etc. In one embodiment, instead of the multiplier staying open until the next trigger occurs, a window is opened in response to the initial trigger occurring and the layered item being provided to the player. The window may represent the number of spins the player has been given in order to reach the multiplier(s) associated with the layered items and use the multiplier(s). For example, upon initiation of the feature, the player may be given a 10-spin window. If it takes the player seven spins (or other gaming events) to reach the multiplier within the layers of the collection of items, then the player would have three spins left to apply the multiplier(s) to the gaming payouts. The feature may end in any desired manner as well, where receiving another of the trigger symbols is just one embodiment. Further, the collection of payout enhancement items may be presented in any fashion, including on or by the slot grid or other game play area, on an auxiliary display, on the top glass of a gaming machine, at one or more symbol locations, etc.

The disclosure sets forth various embodiments which facilitates an understanding of the concepts to one of ordinary skill in the art. Other embodiments are within the teachings provided herein, that are not specifically set forth. An additional embodiment is set forth in FIGS. 6A-6H, which illustrate a succession of stages of a representative slot game depicting an embodiment of a payout enhancement feature providing layered multiplier triggers. The figures generally depict a gaming device embodiment that provides a layered element that includes one or more multipliers associated with a respective one or more of the plurality of layers in the layered element. During game play on a game grid displayed on a game display, a triggering condition may be satisfied in order to receive the layered element. However, additional triggering conditions may need to be satisfied to peel or remove layers of the layered element to work toward the layer associated with the multiplier. When the layer with the multiplier is reached, the multiplier may be applied to the outcome of that, and/or other, gaming events. The layer associated with the multiplier may be unknown to a player or may be communicated to the player.

In some example embodiments, such as will be described in connection with FIGS. 6A-6H, the collection of elements, or "layered element" associated with the multiplier(s) may be a "Matryoshka Doll," although many other types of layered elements may be used in other game embodiments. However, for the purpose of explanation, the example embodiment of the Matryoshka Doll will be discussed below. Here, the game may have an overlay or subsymbol that appears on the reels to act as a trigger for activating and "peeling" the layered element. Thus, when a trigger condition is satisfied in one particular embodiment, one of two things may happen:

1. If the player does not have an active Matryoshka doll, the player is presented with a Matryoshka doll.
2. If the player does have an active Matryoshka doll, the outer-most remaining doll layer is opened, revealing what is inside: either another doll or a multiplier selected from a range.

In this embodiment, once a multiplier is revealed, that multiplier applies to all wins until the next trigger appears, removing the multiplier and presenting the player with another Matryoshka doll, until the feature expires based on any desired termination condition(s).

In other embodiments, instead of the multiplier staying open until they next trigger occurs, it could stay open for a determined number of games, until a win is received, until a losing outcome is received, until a multiplier-removing condition is received, or until another predefined rule is met. In other embodiments, instead of the multiplier staying open until they next trigger occurs, upon the player being given a doll a window is opened. The window is the number of spins or games the player has to reach the multiplier inside the dolls and use them. For example, upon initiation the player is given a 10 spin window. If it takes the player 7 spins to reach the multiplier within the dolls, then the player will have 3 spins remaining in which to apply the multiplier.

This feature may be used in a primary or base game associated with a gaming device or may be used in a free games or free spins bonus event, or other bonus event. The triggering conditions for activating the layered element, removing layers of the layered element, and/or ending a multiplier application period may include one or more types of conditions associated with the game outcomes, associated with an independent game grid overlay, associated with a random or mystery determination, or may be associated with any other type of predefined condition or rule. In some embodiments, where a subsymbol is used as a trigger, a player may receive a multiplier until another subsymbol is received, which gives the player a new layered element.

Referring now to FIGS. 6A-6H, FIG. 6A represents a first slot game grid 600A, after the symbol positions have been populated with game symbols. This embodiment assumes a 3×5 grid 600A (three rows, five columns), which may randomize by reel (i.e. each column spins as an ordered set of symbols), by individual symbol location, or some subset or combination thereof. The particular manner in which symbols populate the grid 600A is not pertinent to the features described herein. Further, while such slot game grids may utilize a single payline, dynamically-generated paylines, a large quantity of paylines, etc., for purposed of this example it is assumed that there are at least five paylines on which symbol combinations are analyzed for payout results. These paylines include a first payline P1 (including symbol locations 601-605), second payline P2 (including symbol locations 606-610), third payline P3 (including symbol locations 611-615), fourth payline P4 (including symbol locations 601, 607, 613, 609, 605), and fifth payline P5 (including symbol locations 611, 607, 603, 609, 615). For purposes of this example, it is also assumed that combinations of five like symbols provide a payout result (although other embodiments may involve different numbers of like symbol combinations).

Figure 6A:
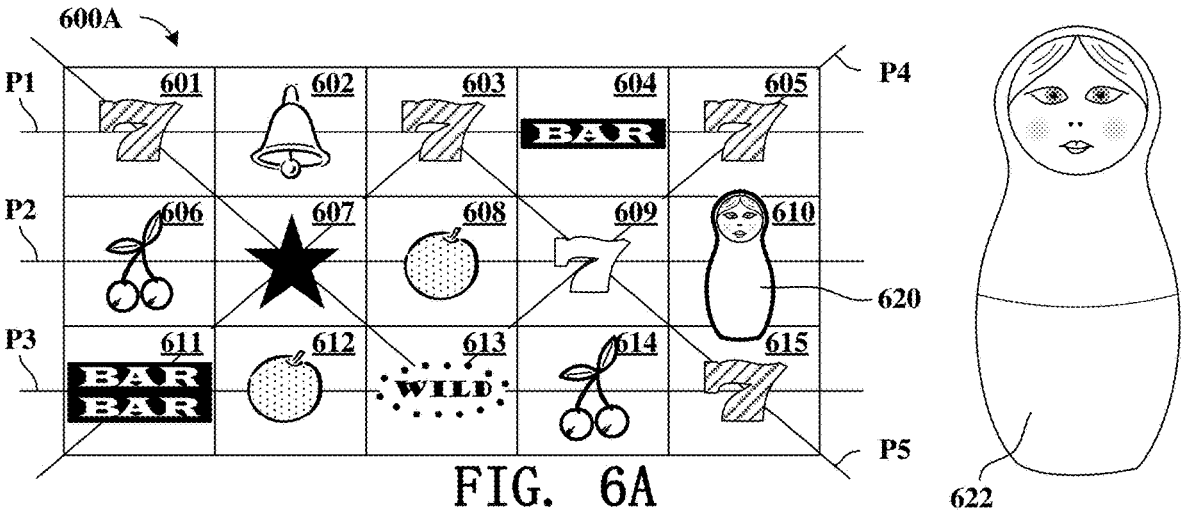
FIGS. 6A-6H illustrate a succession of stages of a representative slot game depicting an embodiment of a payout enhancement feature providing layered multiplier triggers.

The grid 600A of FIG. 6A shows that a trigger condition has been met to initiate a payout enhancement feature as described herein. This example uses Matryoshka Dolls as the layered element (i.e. combination of items), and therefore in one embodiment a Matryoshka Doll symbol serves as the feature trigger indicator 620. The Matryoshka Doll trigger indicator 620 can be a symbol, symbol overlay, sub-symbol, etc., although in the example of FIG. 6A the Matryoshka Doll trigger indicator 620 is a symbol overlay at symbol location 610. When the trigger condition occurs, the payout enhancement feature is initiated, and the player is presented with a layered item, which in the illustrated embodiment is a representation of a Matryoshka Doll 622. The Matryoshka Doll 622 or other layered element used in connection with the feature may be presented at any desired location, such as on or near the grid 600A, on a separate display, or elsewhere. The particular place in which the layered element is presented is of little import, but in one embodiment it is desirable to present an object, a number, or some visual and/or audio indication that the layered element is available to the player.

Figure 6B:
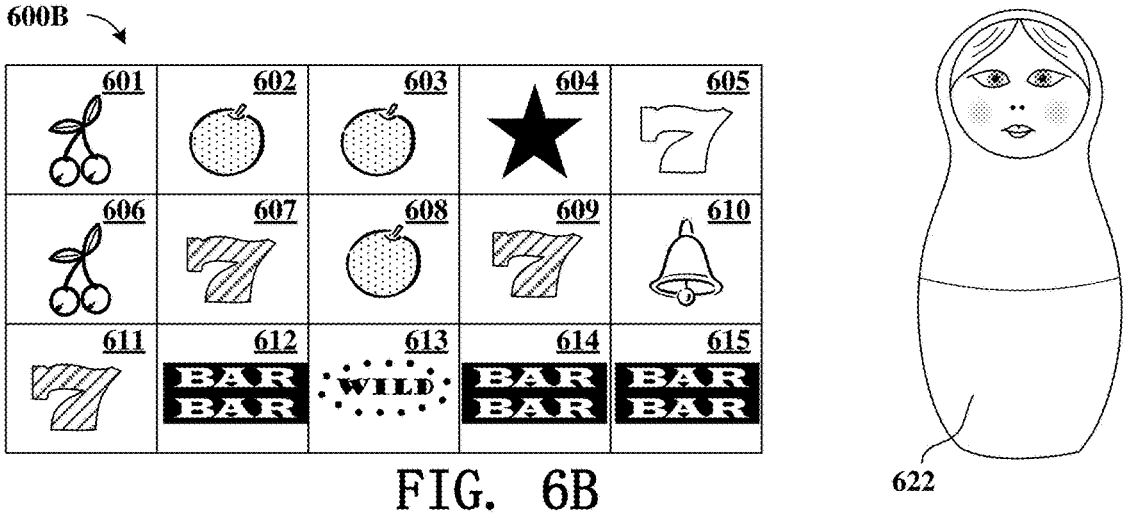

Grid 600B of FIG. 6B depicts the state of a subsequent gaming event, namely after a subsequent reel spin has occurred. In one embodiment, the doll 622 remains as is, allowing the feature to continue, but without providing multipliers, until an interlayer is revealed providing a payout multiplier. Assume on the next reel spin, shown at grid 600C of FIG. 6C, another Matryoshka Doll trigger indicator 624 occurs. In one embodiment, this causes the layered element to reveal another layer, namely, for Matryoshka Doll 622 to open and reveal an inner Matryoshka Doll 626. If there is a multiplier associated with this Matryoshka Doll 626, it would be applied to payouts of subsequent spins (and in some embodiments the current spin result 600C also), and if there is no multiplier associated therewith, the feature continues. In one embodiment, had nothing been inside the outer Matryoshka Doll 622, the feature would end. This is depicted in a more specific example below.

Figure 6C:
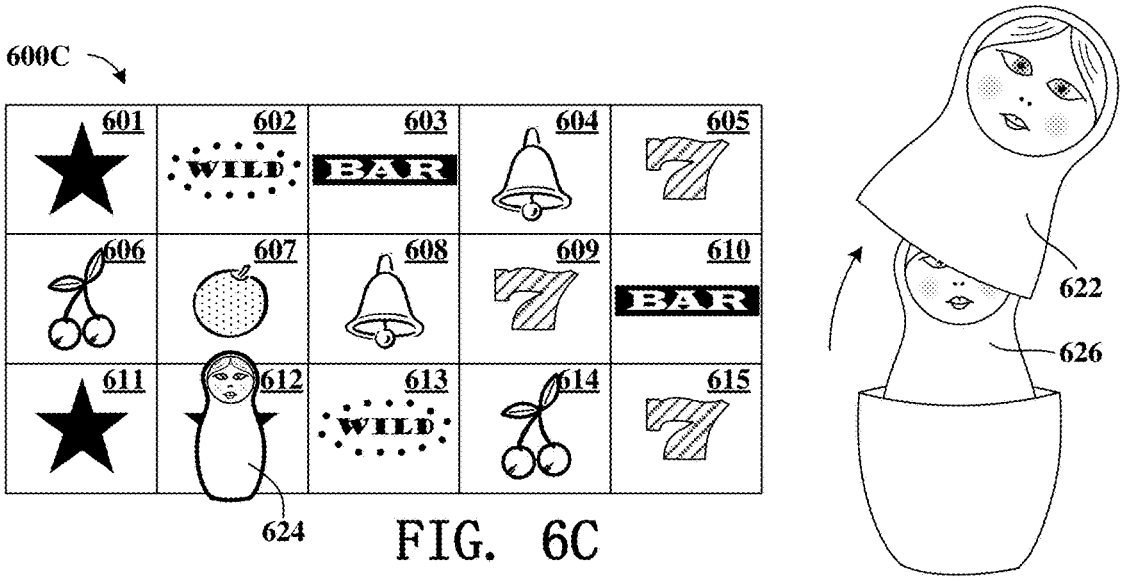

Therefore, at the stage of FIG. 6C, a second trigger indicator 624 had occurred, causing the layered element (Matryoshka Doll 622) to open to reveal an inner layer, with no multiplier, so the feature continues.

Figure 6D:
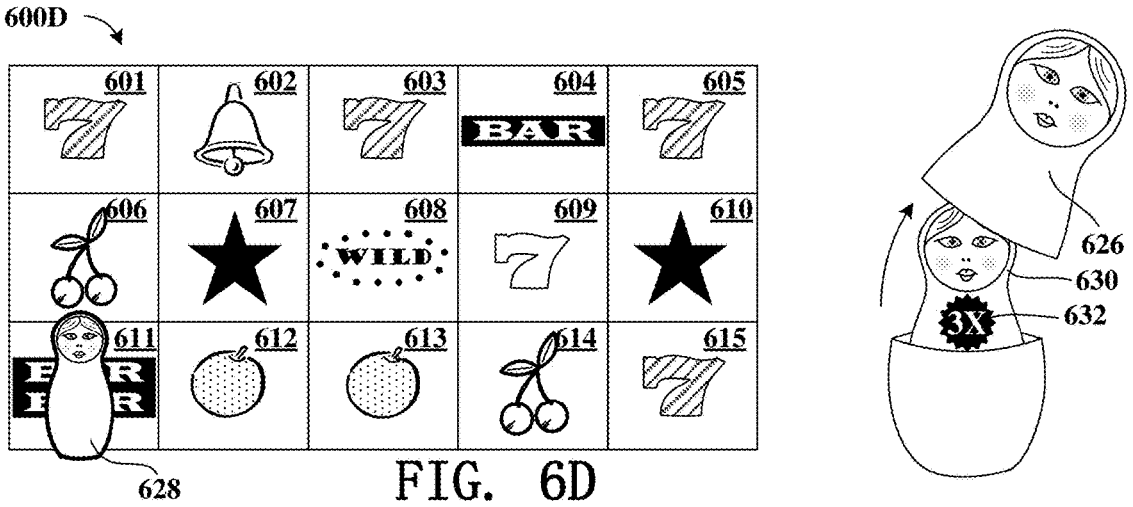
Figure 6E:
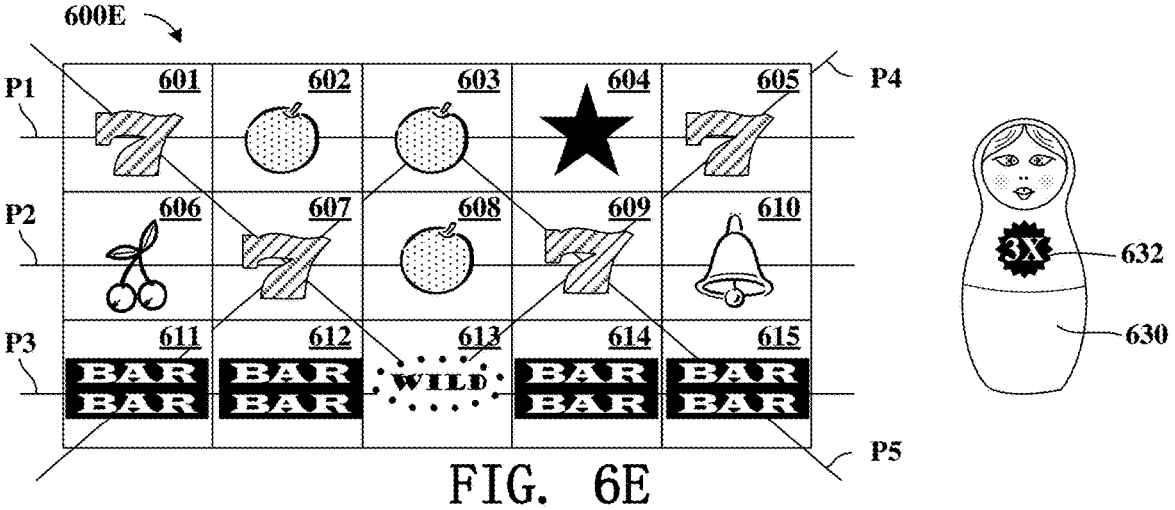

FIG. 6D depicts when yet another trigger indicator 628 occurs in connection with the next reel spin, shown on grid 600D. However, in this instance, a 3× (three times) multiplier 532 is associated with the nested Matryoshka Doll 630 that has been revealed by opening Matryoshka Doll 626. Therefore, in one embodiment, the next reel spins generating payouts will be multiplied by the 3× multiplier 632 until another Matryoshka Doll trigger indicator occurs. For example, FIG. 6E shows slot game grid 600E, where the 3× multiplier 632 is active. The reel spin produced symbols on grid 600E that provide two winning payouts. First is a series of five "7" symbols (including one wild symbol at symbol location 613) on payline P4, which implicates symbol locations 601, 607, 613, 609, and 605. Second, payline P3 includes five "double bar" symbols (including one wild symbol at symbol location 613), which involves symbol locations 611, 612, 613, 614 and 615. Assume for purposes of example that the payout on payline P3 results in 50 credits, and the payout on payline P4 results in 250 credits. Applying the 3× multiplier, the player would win a total of 900 credits on that reel spin (i.e., [50×3]+[250×3]=900).

Figure 6F:
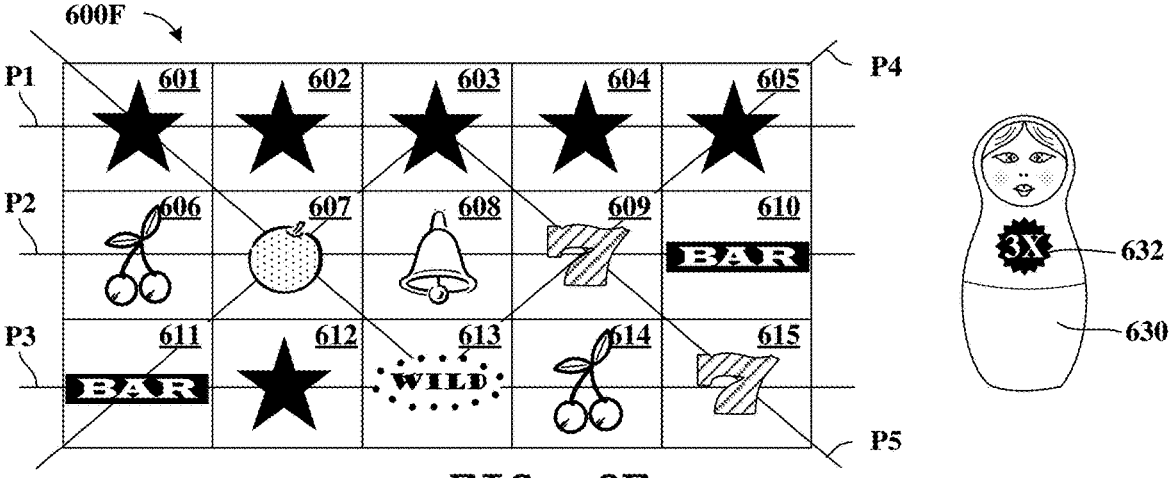

In one embodiment, as long as no further Matryoshka Doll trigger indicator occurs, the 3× multiplier remains active for further reel spins. For example, FIG. 6F shows slot game grid 600F, where the 3× multiplier 632 is still active. The reel spin produced symbols on grid 600F that provide one winning payout on payline P1, which includes five "star" symbols at symbol locations 601, 602, 603, 604 and 605. Assuming a combination of five stars provides a payout of 500 credits, the player would receive 1500 credits (i.e. 500×3=1500).

As can be seen, the multiplier being applied to all payouts for all reel spins until another trigger occurs can be very valuable to the player. In other embodiments, the multiplier may be active only on certain paylines, only for a first number of wins, only applicable to payouts above or below some threshold, or any other desired criteria.

Figure 6G:
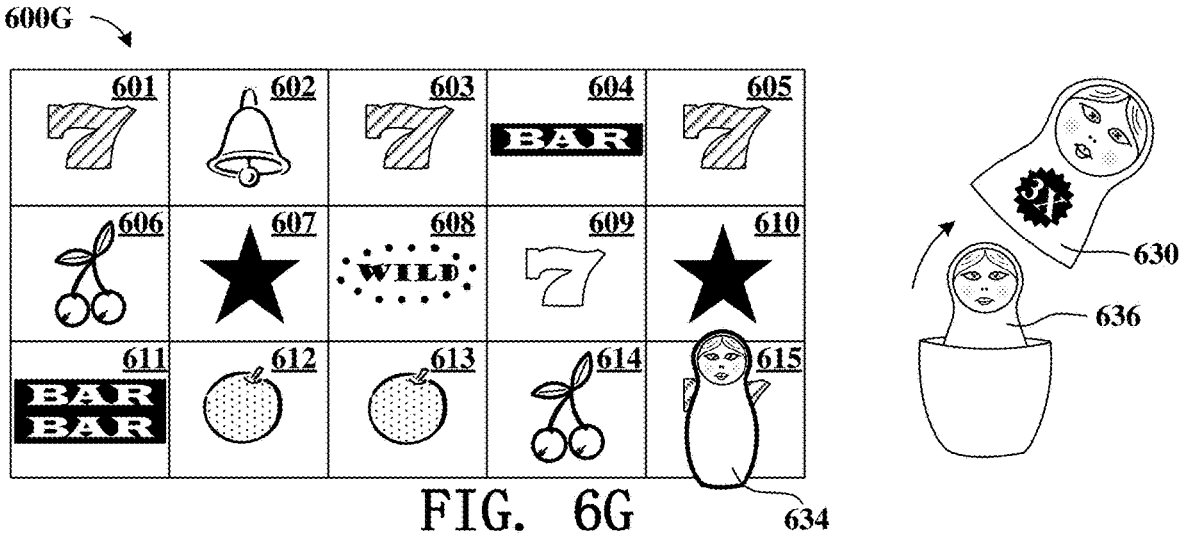

Game play continues, and a subsequent reel spin produces grid 600G shown in FIG. 6G. Here, another Matryoshka Doll trigger indicator 634 occurs. This causes the Matryoshka Doll 630 to open to potentially reveal another nested Matryoshka Doll. If there is no such doll inside current Matryoshka Doll 630, the feature ends. In one embodiment, the feature ends upon receiving another trigger indicator 634 after having been awarded a multiplier. In other embodiments, further multipliers may be awarded through revealing further layered elements, as is the case in the present example of FIGS. 6A-6H. As seen in FIG. 6G, Matryoshka Doll 630 opens to reveal yet another nested Matryoshka Doll 636. Because another trigger 634 occurred, the 3× multiplier 632 ends, and the state of the nested Matryoshka Doll 636 now governs. There is no multiplier associated with Matryoshka Doll 636, so the feature is still activated by virtue of the Matryoshka Doll 636 being present, but any payouts for reel spins will not be awarded a multiplier provided via the Matryoshka Doll feature.

Figure 6H:
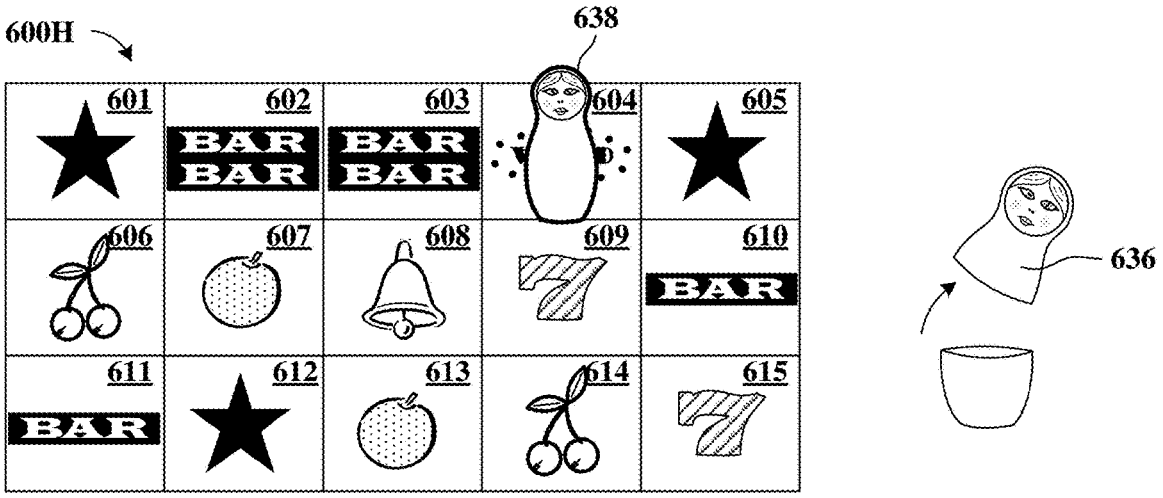

Another reel spin(s) occurs while the temporarily-sustained payout modifier feature is still active, as shown at grid 600H of FIG. 6H. Here, another Matryoshka Doll trigger indicator 638 has arisen in connection with the reel spin, and therefore the Matryoshka Doll 636 is opened to determine whether there are still more nested elements from which a multiplier(s) may be obtained to apply to gaming payouts. In this instance, Matryoshka Doll 636 is proven to be the last nested Matryoshka Doll, as Matryoshka Doll 636 is empty. In one embodiment, this ends the payout modification feature.

Figure 7A:
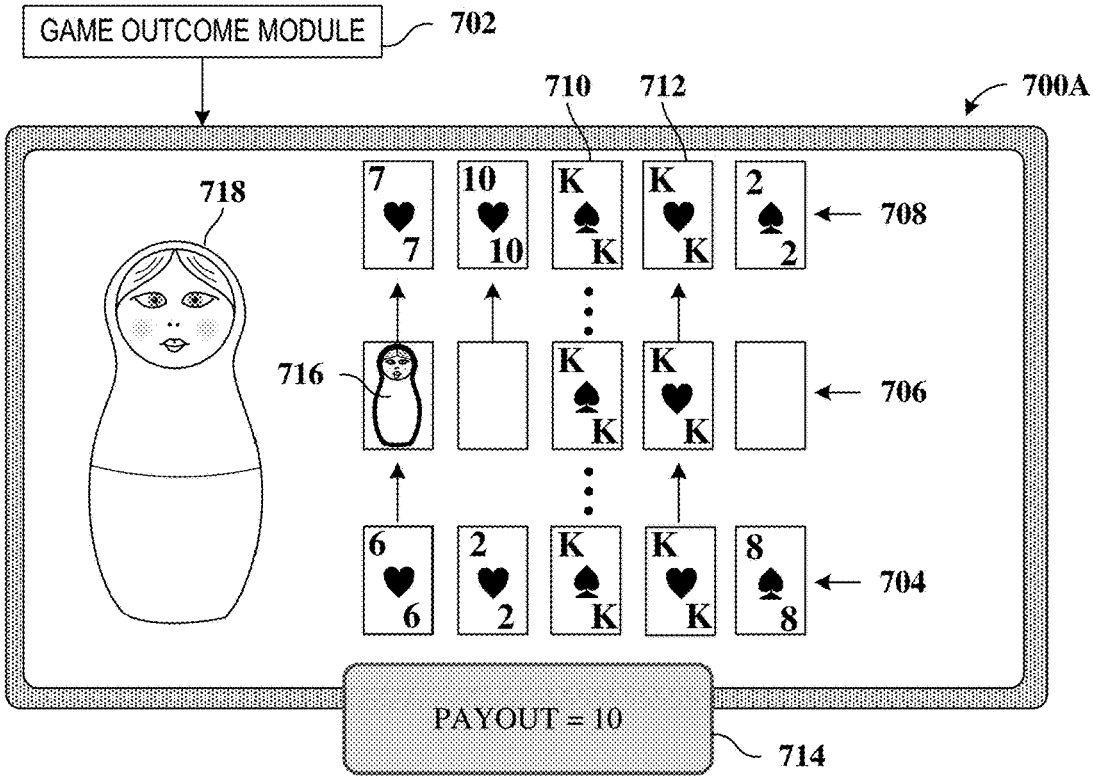
FIGS. 7A and 7B illustrate a poker game embodiment that implements a payout modification feature as described herein.
Figure 7B:
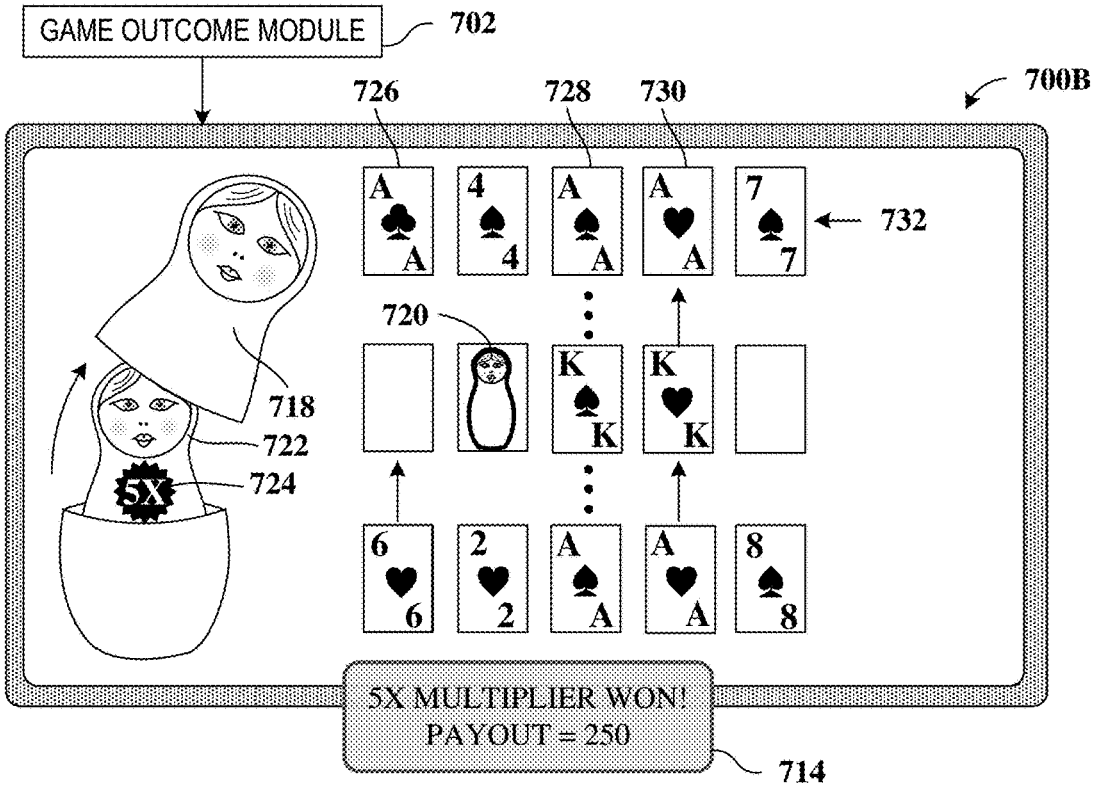

FIGS. 7A and 7B illustrate other representative embodiments of game that implements a payout modification feature as described herein. FIG. 7A depicts a representative draw poker game presented on a gaming display 700A. The game outcome module 702 may represent the software-programmed or otherwise configured hardware to specify a given one or more game combination results, such as poker hands, stud poker hands, hold-em poker hands, or any other card game hands. The game outcome module 702 may include the game probability configuration parameters such as the number of card decks, the number of each card in each deck, and/or other indicia on the cards. These variables provide a natural probability of occurrence of any of the game combination results associated with that card/gaming event. The game outcome module 702 also represents the game combination generation and determination functions which generates one or more card hands, and selects the original cards/hands, any replacement cards/hands (e.g., draw cards), etc. to produce game outcomes.

In the example of FIG. 7A, an original hand 704 is dealt, that by chance includes a Six of Hearts (6-H), Two of Hearts (2-H), King of Spades (K-S), King of Hearts (K-H), and Eight of Spades (8-S). As this example is a draw poker embodiment, the player is allowed to retain or "hold" one or more cards of the original hand 704. In this example, the player holds two cards (assume the K-S and K-H) and discards the rest as depicted at intermediate hand 706. When the discarded cards are replaced to provide a final hand 708, the best payout available for the cards of the final hand 708 are a pair of kings, including the K-S 710 and the K-H 712, which is assumed to pay ten (10) credits in this example, as may be presented via a display window 714 or elsewhere.

The payout enhancement features described herein may be implemented in such a poker game. During play of this hand, a trigger indicator, such as Matryoshka Doll trigger indicator 716, may be presented anywhere, such as randomly presented at a discarded card location, on an secondary display, on a dealt card, as a sub-symbol, or the like. When presented, a layered or nested element is provided, such as the exemplary Matryoshka Doll 718. Thus, the payout enhancement feature is now active.

The feature operates analogously to that previously described, and in one embodiment operates with the poker game analogously to that of FIGS. 6A-6H. Thus, on a subsequent hand depicted in FIG. 7B, another trigger indicator 720 occurred, which causes the Matryoshka Doll 718 to open to determine if another Matryoshka Doll is nested therein. In this case, there is another Matryoshka Doll 722 that includes a 5× multiplier 724. As in previously-described embodiments, this 5× multiplier 724 is, in some embodiments, available for use to apply to final hand payouts until another trigger indicator is received on a subsequent hand. For the present hand, the player ultimately receives three Aces 726, 728, 730. Assuming three Aces provides a payout of 50 credits in this example, the player would receive a total of 250 credits as shown via display window 714, since the 5× multiplier 724 was active. Again, the process may continue as was described in FIGS. 6A-6H or elsewhere in the present disclosure.

The features described herein can be used in connection with any game of chance, including slot games, poker games, keno, roulette, bingo, and the like. They may be provided using physical structures, or electronic structures created in computing hardware and displayed as virtual structures of such physical structures. The gaming events described herein may be provided as a base game of chance or an auxiliary gaming event such as a bonus event, free spin event, or other secondary event.

Figure 8A:
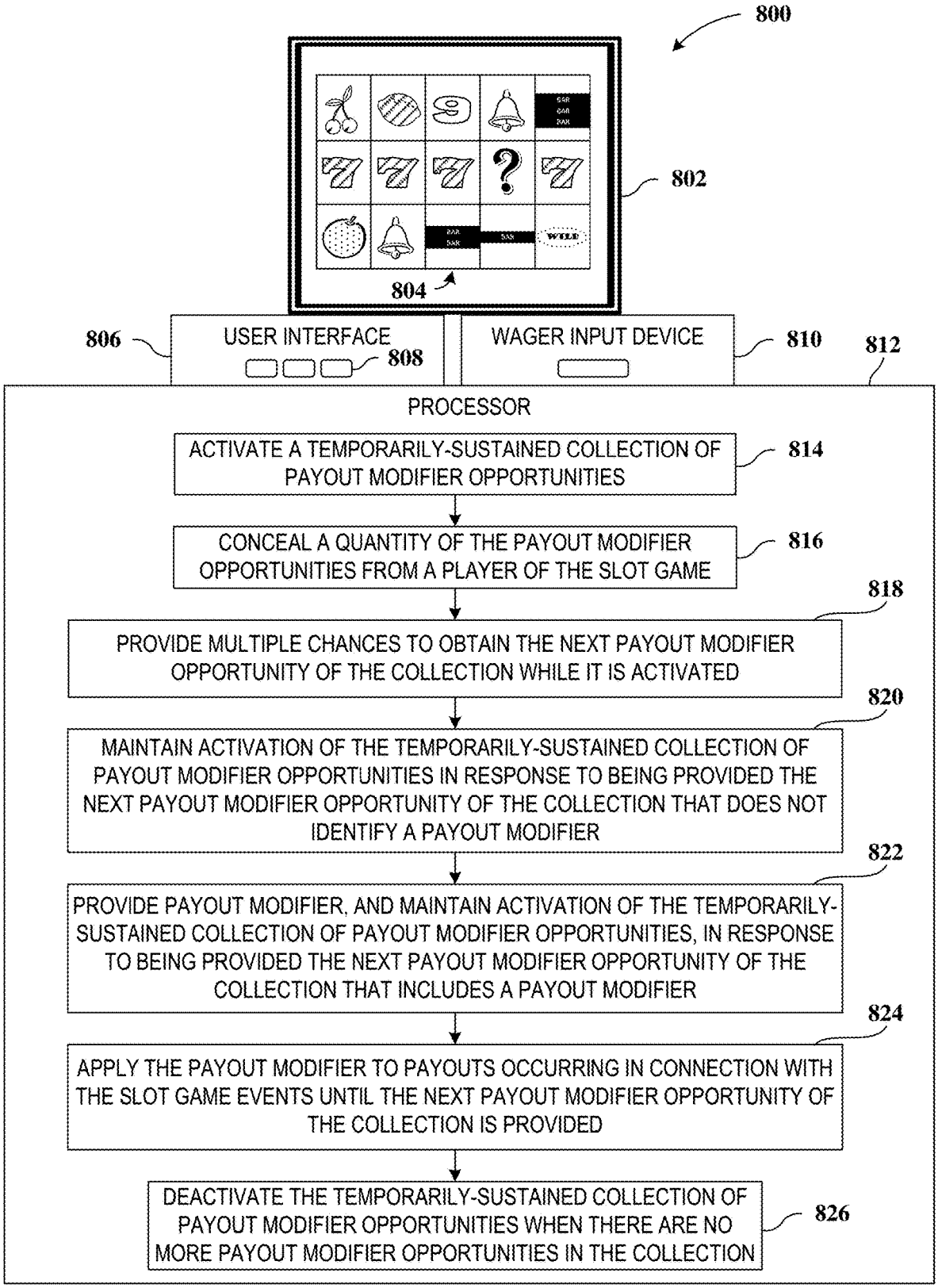
FIGS. 8A and 8B are block diagrams of representative alternative slot game apparatuses for using layered/nested collections of elements to identify payout modifiers in accordance with the disclosure.
Figure 8B:
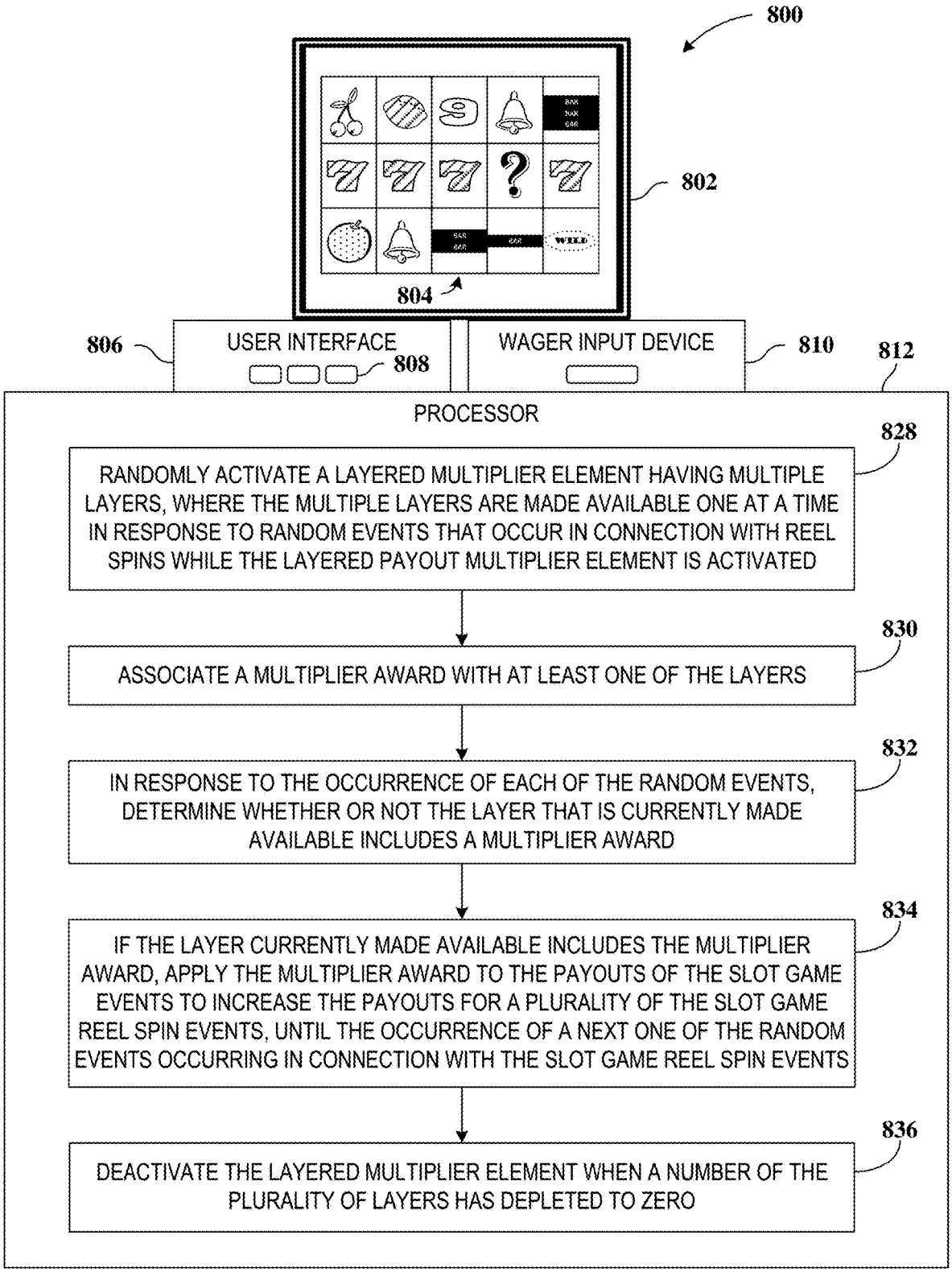

FIGS. 8A and 8B are block diagrams of representative alternative slot game apparatuses for using layered/nested collections of elements to identify payout modifiers in accordance with the disclosure. In the embodiment of FIG. 8A, a slot game device 800 is provided on which players can play slot games. The representative slot game device 800 includes at least a display 802 presenting a slot game symbol array or "grid" 804 of symbol locations, a user interface 806 including at least one user input 808 to enable a player to initiate a slot game event presented via the slot game grid 804, and a wager input device 810 structured to identify and validate player assets and ultimately permit the player to play the slot game event when the player assets are provided. The slot game device 800 also includes a processor 812 configured to activate 814 a temporarily-sustained collection of payout modifier opportunities, and conceal 816 the number of payout modifier opportunities from the slot game player. The processor 812 is further configured to provide 818 a plurality of chances to obtain the next one of the collection of payout modifier opportunities while the temporarily-sustained collection is activated. As shown at block 820, the processor 812 is configured to maintain activation of the temporarily-sustained collection of payout modifier opportunities in response to being provided the next one of the collection of payout modifier opportunities that identifies no payout modifier, but when a payout modifier is associated with the next payout modifier opportunity, then in addition to maintaining activation of the temporarily-sustained collection of payout modifier opportunities, a payout modifier is provided as depicted at block 822. The processor 812 is further configured to apply 824 the payout modifier to payouts occurring in connection with the slot game events until the next one of the collection of payout modifier opportunities is provided, and to deactivate 826 the temporarily-sustained collection of payout modifier opportunities when all of the quantity of the payout modifier opportunities have been provided.

The slot game device 800 configures the processor 812 (which may include one or more cooperative processing devices) to structurally program functional elements into hardware modules. Processor 812 circuitry configuration thus changes based on the modules developed by software to carry out the desired methodology. For example, the processor 812 is programmed by software/code to create a hardware-based module to activate 814 the payout enhancement feature and to create other such software/code modules for each of the operations 814-826.

Other structural modules may be created on the slot game device using a properly configured processor 812. Referring now to the example of FIG. 8B, the processor 812 may be configured into programmed modules to randomly activate 828 a layered multiplier element that has multiple layers, made available one at a time, in response to random events occurring in connection with slot game reel spin events while the layered payout multiplier element is activated. The processor 812 is further configured to associate 830 a multiplier award with at least one of the layers, and in response to the occurrence of each of the random events, determine 832 whether or not the layer that is currently made available includes a multiplier award. If the layer currently made available includes the multiplier award, the processor is configured to apply 834 the multiplier award to the payouts of the slot game events to increase the payouts for a plurality of the slot game reel spin events, until the occurrence of a next one of the random events occurring in connection with the slot game reel spin events. When there are no more layers, the layered multiplier element is deactivated 836.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A slot game apparatus for enhancing gaming awards in a slot game having discrete slot game events where symbols are randomly positioned in respective symbol positions of a symbol array to determine payouts, comprising:

a display presenting the symbol positions forming the symbol array, and presenting the randomly positioned symbols for each of the discrete slot game events;

a user interface including at least one user input to enable a player to initiate a slot game event presented via the symbol array;

a wager input device structured to identify and validate player assets, and to permit the player to play the slot game event when the player assets are provided; and a processor configured to:

activate a temporarily-sustained collection of payout modifier opportunities over a plurality of the slot game events;

cause the display to depict that the temporarily-sustained collection of payout modifier opportunities has been activated;

conceal a quantity of the payout modifier opportunities from a player of the slot game;

provide a plurality of chances to obtain a next one of the temporarily-sustained collection of payout modifier opportunities while the temporarily-sustained collection of payout opportunities is activated over the plurality of the slot game events, and to cause the display to depict when the next one of the temporarily-sustained collection of payout modifier opportunities has been obtained;

maintain activation of the temporarily-sustained collection of payout modifier opportunities for at least one additional one of the slot game events in response to being provided the next one of the temporarily-sustained collection of payout modifier opportunities that identifies no payout modifier, and to cause the display to indicate that no payout modifier was identified;

provide a payout modifier, and maintain activation of the temporarily-sustained collection of payout modifier opportunities for at least one additional one of the slot game events, in response to being provided the next one of the temporarily-sustained collection of payout modifier opportunities that has the payout modifier associated therewith, and to cause the display to indicate that the payout modifier was provided;

apply the payout modifier to payouts occurring in connection with one or more of the slot game events until the next one of the temporarily-sustained collection of payout modifier opportunities is provided; and deactivate the temporarily-sustained collection of payout modifier opportunities when all of the quantity of the payout modifier opportunities have been provided, and cause the display to indicate that the temporarily-sustained collection of payout modifier opportunities is no longer activated.

2. The slot game apparatus of claim 1, wherein the temporarily-sustained collection of payout modifier opportunities comprises a series of layered elements, each of the elements including one of the payout modifier opportunities, and wherein the processor is configured to provide the next one of the collection of payout modifier opportunities by causing the display to reveal a next layer of the series of layered elements.

3. The slot game apparatus of claim 2, wherein the processor is further configured to deactivate the temporarily-sustained collection of payout modifier opportunities when there is no next layer of the series of layered elements.

4. The slot game apparatus of claim 2, wherein the processor is further configured to reveal the next layer of the series of layered elements without revealing a remaining quantity of the series of layered elements.

5. The slot game apparatus of claim 2, wherein the series of layered elements comprises a plurality of nested matryoshka dolls, each of the nested matryoshka dolls including one of the payout modifier opportunities, and wherein the processor is configured to provide the next one of the collection of payout modifier opportunities by causing the display to reveal a next nested one of the matryoshka dolls.

6. The slot game apparatus of claim 1, wherein the processor is configured to apply the modifier to all of the payouts occurring in connection with a plurality of the slot game events until the next one of the collection of payout modifier opportunities is provided.

7. The slot game apparatus of claim 1, wherein the processor is further configured to activate the temporarily-sustained collection of payout modifier opportunities in response to occurrence of a random event occurring in connection with participation of one of the slot game events.

8. The slot game apparatus of claim 1, wherein the processor is further configured to provide the plurality of chances to obtain the next one of the collection of payout modifier opportunities by randomly providing a visual identifier in connection with a plurality of the slot game events occurring during the temporarily-sustained collection of payout modifier opportunities.

9. The slot game apparatus of claim 1, wherein at least one of the payout modifier opportunities comprises the payout modifier, and wherein at least one of the payout modifier opportunities does not comprise the payout modifier.

10. The slot game apparatus of claim 9, wherein a plurality of the payout modifier opportunities comprise the payout modifiers, and wherein at least two different modifier values are respectively provided by way of the plurality of the payout modifier opportunities.

11. A slot game apparatus for enhancing gaming awards in a slot game having discrete slot game reel spin events where symbols are randomly positioned in respective symbol positions of a symbol array to determine payouts, comprising:

a display presenting a plurality of the symbol positions forming the symbol array;

a user interface including at least one user input to enable a player to initiate the slot game reel spin events presented via the symbol array;

a wager input device structured to identify and validate player assets, and to permit the player to play the slot game reel spin event when the player assets are provided; and a processor configured to:

randomly activate a layered multiplier element having a plurality of layers made available one at a time in response to random events occurring in connection with slot game reel spin events while the layered multiplier element is activated;

cause the display to depict that the layered multiplier element has been activated;

associate a multiplier award with at least one of the plurality of layers;

in response to the occurrence of each of the random events, determine whether or not the layer that is currently made available includes a multiplier award;

if the layer currently made available includes the multiplier award, cause the display to present the multiplier award, and apply the multiplier award to the payouts of the slot game reel spin events to increase the payouts for a plurality of the slot game reel spin events, until the occurrence of a next one of the random events occurring in connection with the slot game reel spin events;

deactivate the layered multiplier element when a number of the plurality of layers has depleted to zero; and cause the display to depict that the layered multiplier element has been deactivated.

12. The slot game apparatus of claim 11, wherein the processor is further configured to maintain the activation of the layered multiplier element, if the layer currently made available does not include the multiplier award, and the number of the plurality of layers has not yet depleted to zero.

13. The slot game apparatus of claim 11, wherein the processor is configured to make the plurality of layers available one at a time, revealing only the one of the plurality of layers that is currently available, and concealing any remaining ones of the plurality of layers and concealing the number of the remaining ones of the plurality of layers.

14. The slot game apparatus of claim 11, wherein the processor is configured to make the plurality of layers available one at a time, revealing only the one of the plurality of layers that is currently available and concealing any remaining ones of the plurality of layers, and revealing the number of the remaining ones of the plurality of layers.

15. The slot game apparatus of claim 11, wherein the processor is configured to apply the multiplier award by multiplying all of the payouts during the plurality of the slot game reel spin events until the occurrence of the next one of the random events occurring in connection with the slot game reel spin events.

16. The slot game apparatus of claim 11, wherein the processor is configured to create the random events to make available, at times but not always, one of the plurality of layers for the determination of whether or not the layer that is currently made available includes the multiplier award.

17. The slot game apparatus of claim 11, wherein the random event is selected from the group comprising a special symbol, a symbol overlay, a sub-symbol, and an indication separate from the slot game reel spin event.

18. The slot game apparatus of claim 11, wherein the multiplier award comprises any of a plurality of available multiplier values.

19. A slot game apparatus for enhancing gaming awards in a slot game having discrete slot game events where symbols are randomly positioned in respective symbol positions of a symbol array to determine payouts, comprising:

a display presenting a plurality of the symbol positions forming the symbol array;

a user interface including at least one user input to enable a player to initiate each of the slot game events presented via the symbol array;

a wager input device structured to identify and validate player assets, and to permit the player to play the slot game event when the player assets are provided; and a processor configured to:

randomly activate a layered multiplier element having a plurality of layers made available one at a time in response to random events occurring in connection with slot game events while the layered multiplier element is activated;

cause the display to depict that the layered multiplier element has been activated;

associate a multiplier award with at least one of the plurality of layers;

in response to the occurrence of each of the random events, determine whether or not the layer that is currently made available includes a multiplier award;

if the layer currently made available includes the multiplier award, cause the display to present the multiplier award, and apply the multiplier award to the payouts of the slot game events to increase the payouts for a plurality of the slot game events, until a number of the slot game events has occurred;

deactivate the layered multiplier element when a number of the plurality of layers has depleted to zero; and cause the display to depict that the layered multiplier element has been deactivated.

20. The slot game apparatus of claim 11, wherein the processor is configured to apply the multiplier awards until a predetermined number of the slot game events has occurred.

* * * * *